US009173454B2

(12) United States Patent
Liu

(10) Patent No.: US 9,173,454 B2
(45) Date of Patent: Nov. 3, 2015

(54) BELT HEAD WITH REPLACEABLE BUCKLE PORTION

(71) Applicant: Hsin-Ta Liu, Changhua (TW)

(72) Inventor: Hsin-Ta Liu, Changhua (TW)

( * ) Notice: Subject to any disclaimer, the term of this patent is extended or adjusted under 35 U.S.C. 154(b) by 131 days.

(21) Appl. No.: 13/849,350

(22) Filed: Mar. 22, 2013

(65) Prior Publication Data

US 2014/0215766 A1 Aug. 7, 2014

(30) Foreign Application Priority Data

Feb. 7, 2013 (TW) ..... 102104944 A

(51) Int. Cl.

| | |
|---|---|
| ***A44B 11/25*** | (2006.01) |
| ***A44B 11/00*** | (2006.01) |
| *A41F 9/00* | (2006.01) |
| *A44B 11/24* | (2006.01) |

(52) U.S. Cl.

CPC ..... *A44B 11/006* (2013.01); *A41F 9/002* (2013.01); *A44B 11/24* (2013.01); *Y10T 24/4065* (2015.01)

(58) Field of Classification Search

CPC ..... A44B 11/25; A44B 11/006; A44B 11/28; A44B 11/2511

USPC ..... 24/188, 265 BC, 265 EC, 178, 280, 24/163 R

See application file for complete search history.

(56) References Cited

U.S. PATENT DOCUMENTS

| | | | | | |
|---|---|---|---|---|---|
| 1,392,237 | A | * | 9/1921 | Starmer | 24/188 |
| 1,477,597 | A | * | 12/1923 | Schneider | 24/616 |
| 1,737,246 | A | * | 11/1929 | Jones | 24/616 |
| 2,067,484 | A | * | 1/1937 | Freysinger | 24/316 |
| 2,629,104 | A | * | 2/1953 | Easlick | 2/322 |
| 2,630,612 | A | * | 3/1953 | Stark | 24/178 |
| 2,806,275 | A | * | 9/1957 | Stoll | 24/265 BC |
| 2,807,849 | A | * | 10/1957 | Legat | 24/316 |
| 2,865,074 | A | * | 12/1958 | Meeker | 24/188 |
| 3,017,641 | A | * | 1/1962 | Stollman | 2/322 |
| 3,308,516 | A | * | 3/1967 | Mullan | 24/310 |
| 3,562,766 | A | * | 2/1971 | Dye | 2/321 |
| 3,605,210 | A | * | 9/1971 | Lohr | 24/635 |
| 3,665,565 | A | * | 5/1972 | Kruger | 24/265 WS |
| 4,217,681 | A | * | 8/1980 | Grohoski et al. | 24/265 WS |
| 4,281,440 | A | * | 8/1981 | Britz | 24/191 |
| 4,406,043 | A | * | 9/1983 | Friedman | 24/171 |

(Continued)

FOREIGN PATENT DOCUMENTS

| | | | | |
|---|---|---|---|---|
| GB | 2231082 A | * | 11/1990 | A44B 11/25 |
| TW | 205627 | | 5/1993 | |
| TW | M311291 | | 5/2007 | |

*Primary Examiner* — Victor Batson
*Assistant Examiner* — Jason W San
(74) *Attorney, Agent, or Firm* — Muncy, Geissler, Olds & Lowe, P.C.

(57) ABSTRACT

A belt head includes a seat, a buckle portion, an engaging portion and a button. The seat has a front side portion having two narrow side surfaces facing to each other and a rear side portion used to connect and fix an end of a strap. The buckle portion has a connecting base connected with the front side portion and a fastening base which has a passage enabling the other end of the strap to pass through and a fastener for fastening or releasing the strap. The engaging portion is disposed on the front side portion and is movable between a first and second positions to engage with and release from a blocking member of the connecting base. The button is located on one of the narrow side surfaces of the front side portion for controlling the engaging portion to move between the first and second positions.

12 Claims, 12 Drawing Sheets

(56) References Cited

U.S. PATENT DOCUMENTS

| | | | | | |
|---|---|---|---|---|---|
| 4,419,792 | A * | 12/1983 | Kohli | 24/170 |
| 4,458,390 | A * | 7/1984 | Fogelson | 24/182 |
| 4,539,736 | A * | 9/1985 | Yokosuka | 24/644 |
| 5,309,610 | A * | 5/1994 | le Gal | 24/625 |
| 5,341,544 | A * | 8/1994 | Richter et al. | 24/289 |
| 5,440,792 | A * | 8/1995 | Ida | 24/615 |
| 5,673,463 | A * | 10/1997 | Chih-wen | 24/265 BC |
| 5,875,523 | A * | 3/1999 | Chen | 24/171 |
| 6,108,821 | A * | 8/2000 | Malsoute | 2/321 |
| 6,145,169 | A * | 11/2000 | Terzuola et al. | 24/170 |
| 6,389,653 | B1 * | 5/2002 | Matoba | 24/265 BC |
| 6,571,434 | B2 * | 6/2003 | Ortiz | 24/615 |
| 6,606,770 | B1 * | 8/2003 | Badrenas Buscart | 24/625 |
| 6,668,434 | B2 * | 12/2003 | Casebolt et al. | 24/634 |
| 6,687,964 | B2 * | 2/2004 | Vanderpool | 24/614 |
| 7,114,225 | B2 * | 10/2006 | Casebolt et al. | 24/634 |
| 7,373,701 | B2 * | 5/2008 | Coulombe et al. | 24/648 |
| 7,480,967 | B2 * | 1/2009 | Kojoori et al. | 24/163 R |
| 7,712,192 | B2 * | 5/2010 | Lin et al. | 24/70 ST |
| 7,743,473 | B2 * | 6/2010 | Lin et al. | 24/71 ST |
| 7,946,103 | B2 * | 5/2011 | So et al. | 59/80 |
| 8,065,781 | B2 * | 11/2011 | Chao | 24/70 ST |
| 8,176,605 | B2 * | 5/2012 | Mok | 24/614 |
| 8,181,319 | B2 * | 5/2012 | Johnson et al. | 24/648 |
| 8,365,364 | B2 * | 2/2013 | Labelson et al. | 24/163 R |
| 2002/0002761 | A1 * | 1/2002 | Novak | 24/312 |
| 2003/0182777 | A1 * | 10/2003 | Kim | 24/615 |
| 2006/0218761 | A1 * | 10/2006 | Anscher | 24/614 |
| 2006/0288546 | A1 * | 12/2006 | Wu | 24/615 |
| 2008/0041126 | A1 * | 2/2008 | Yu | 70/58 |
| 2008/0168634 | A1 * | 7/2008 | Chen et al. | 24/633 |

* cited by examiner

BELT HEAD WITH REPLACEABLE BUCKLE PORTION

BACKGROUND OF INVENTION

1. Field of Invention

The present invention relates to a belt head, and more particularly to a belt head that has a replaceable buckle portion.

2. Related Prior Art

A belt worn on pants or skirts is mainly composed of a strap and a belt head made of metal. The belt head comprises a seat connected with an end of the strap and a buckle portion enabling the other end of the strap to pass through and being operated to fasten or release the strap. The buckle portion of the prior belt can be designed as a fashion accessory for providing people with a visual experience. However, since the buckle portion and the seat of the belt head are pivotably connected and fixed together by means of riveting, it is necessary to replace the entire belt head once the wearer wants to change the buckle portion to suit their clothes for a different visual experience, or once the buckle portion is damaged.

In order to solve this problem, Taiwan Pat. No. 205627 and M31.1291, for example, disclosed plural designs of the belt head having the buckle portion and the seat that can be detached from each other in the past. Nevertheless, there is a need to create a better design for the belt head having the buckle portion and the seat that can be detached from each other.

SUMMARY OF INVENTION

It is an object of the present invention to provide a new belt head which has a button and an engaging portion, which can achieve the purpose of replacing a buckle portion of the belt head by operating the button of the belt head. Comparing to the prior art, the belt head of the present invention has a buckle portion that is easily replaced.

In detail, the belt head of the present invention comprises a seat, a buckle portion, a first engaging portion and a first button. The seat has a front end portion and a rear end portion. The front end portion has two narrow side surfaces facing to each other, and the rear end portion is used to connect with and fix an end of a strap. The buckle portion has a connecting base and a fastening base. The connecting base is connected with the front end portion of the seat and has a first blocking member. The fastening base has a passage and a fastener, wherein the passage is used to enable the opposite end of the strap to pass through, and the fastener is used to fasten or release the strap. The first engaging portion is disposed on the front end portion of the seat and is movable between a first position where the first engaging portion engages with the first blocking member of the connecting base and a second position where first engaging portion releases from the first blocking member. The first button is located on one of the narrow side surfaces of the front end portion and serves as a switch to control the first engaging portion to move between the first and second positions. Preferably, the connecting base and the fastening base are pivotably connected together and are rotatable about each other.

Preferably, the first engaging portion is pivotably connected with the front end portion and has a hook at one end thereof for engaging with or releasing from the first blocking member. The first button extends from the opposite end of the first engaging portion and protrudes slightly from the one of the narrow side surfaces of the front end portion of the seat. A pivot joint where the first engaging portion is pivotably connected with the front end portion of the seat is located between the hook and the first button and is closer to the first button.

Preferably, the belt head of the present invention further includes a first resilient member disposed between the first engaging portion and the front end portion of the seat. The first resilient member is used to provide an elastic force that enables the hook of the first engaging portion to bounce toward the first blocking member of the connecting base.

Preferably, the belt head of the present invention further includes first supporting block protruding from the front end portion of the seat. The first supporting block faces the hook of the first engaging portion, and while the hook is moved to engage with a side of the first blocking member, the opposite side of the first blocking member abuts against the first supporting block.

In other words, the belt head of the present invention achieves it purpose by disposing an engagement mechanism, which consists of the first engaging portion, the first button, the first resilient member and the first supporting member, on the seat with disposing the first blocking member on the buckle portion. However, the belt head of the present invention can further has another engagement mechanism, which is similar to the abovementioned engagement mechanism, disposed on the seat, and a second blocking member, which is similar to the first blocking member, disposed on the buckle portion and corresponding to the another engagement mechanism.

Preferably, any one of the engagement mechanisms abovementioned can be respectively or simultaneously changed to be disposed on the buckle portion, and the first and second blocking members can be respectively or simultaneously changed to be disposed on the seat.

Accordingly, the buckle portion of the belt head of the present invention is able to be detached from the seat for replacing a new buckle portion, and the new buckle portion can be assembled to the seat. The process about detaching the buckle portion from the seat or assembling the new buckle portion to the seat is easy, fast and convenient.

Further features and advantages of the present invention will be appreciated by review of the following detailed description of the invention.

DETAILED DESCRIPTION OF EMBODIMENTS

Figure 1:
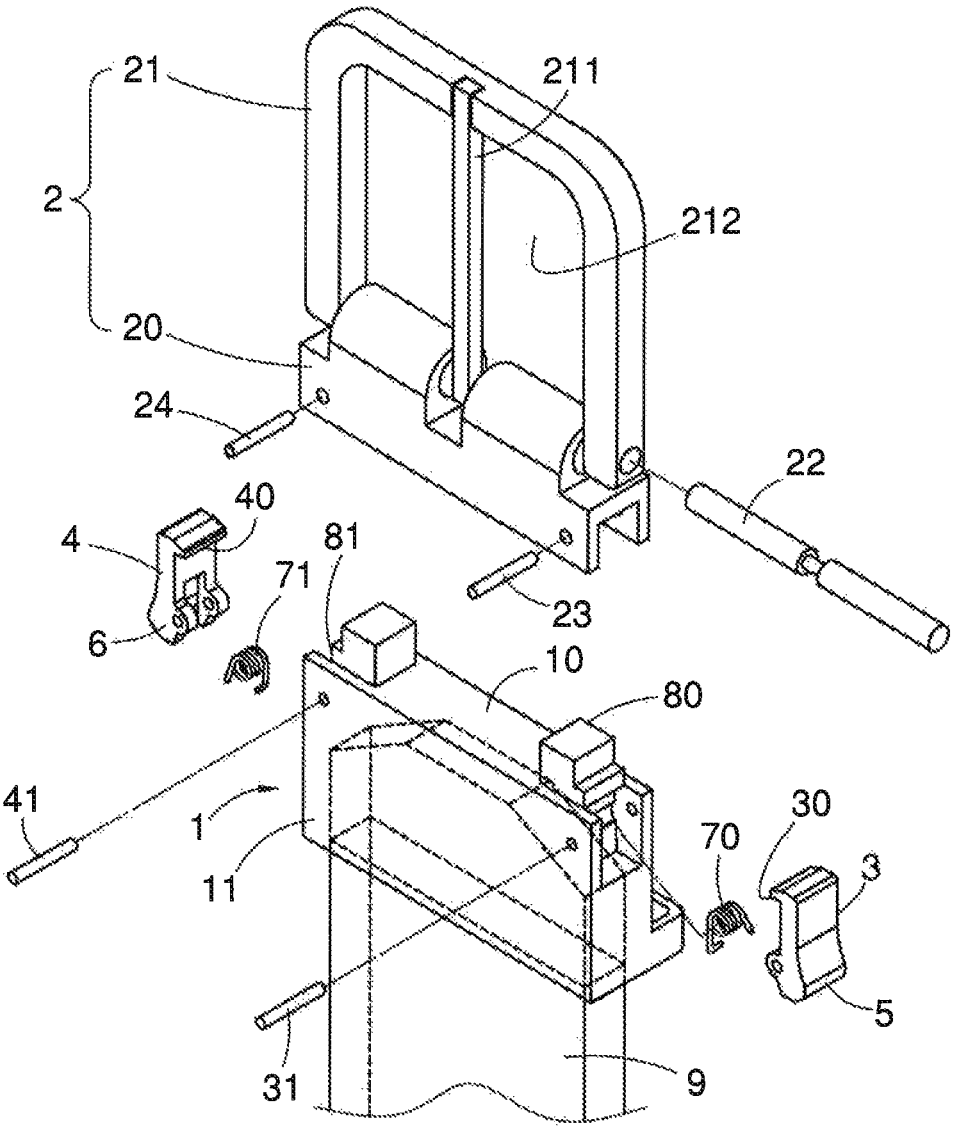
FIG. 1 is an exploded view of a belt head according to a first embodiment of the present invention.
Figure 2:
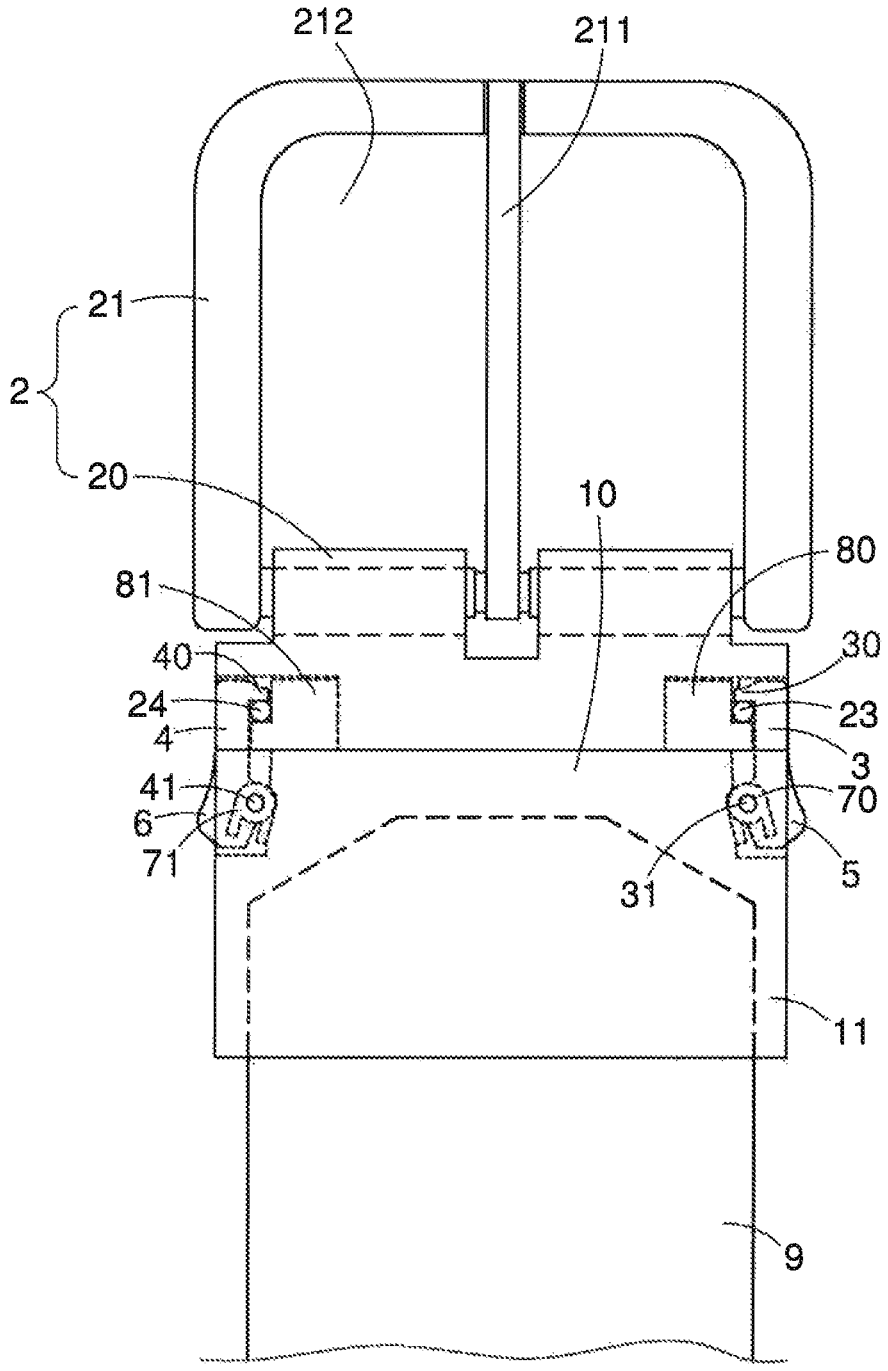
FIG. 2 is a plan view of the belt head according to the first embodiment of the present invention.
Figure 3:
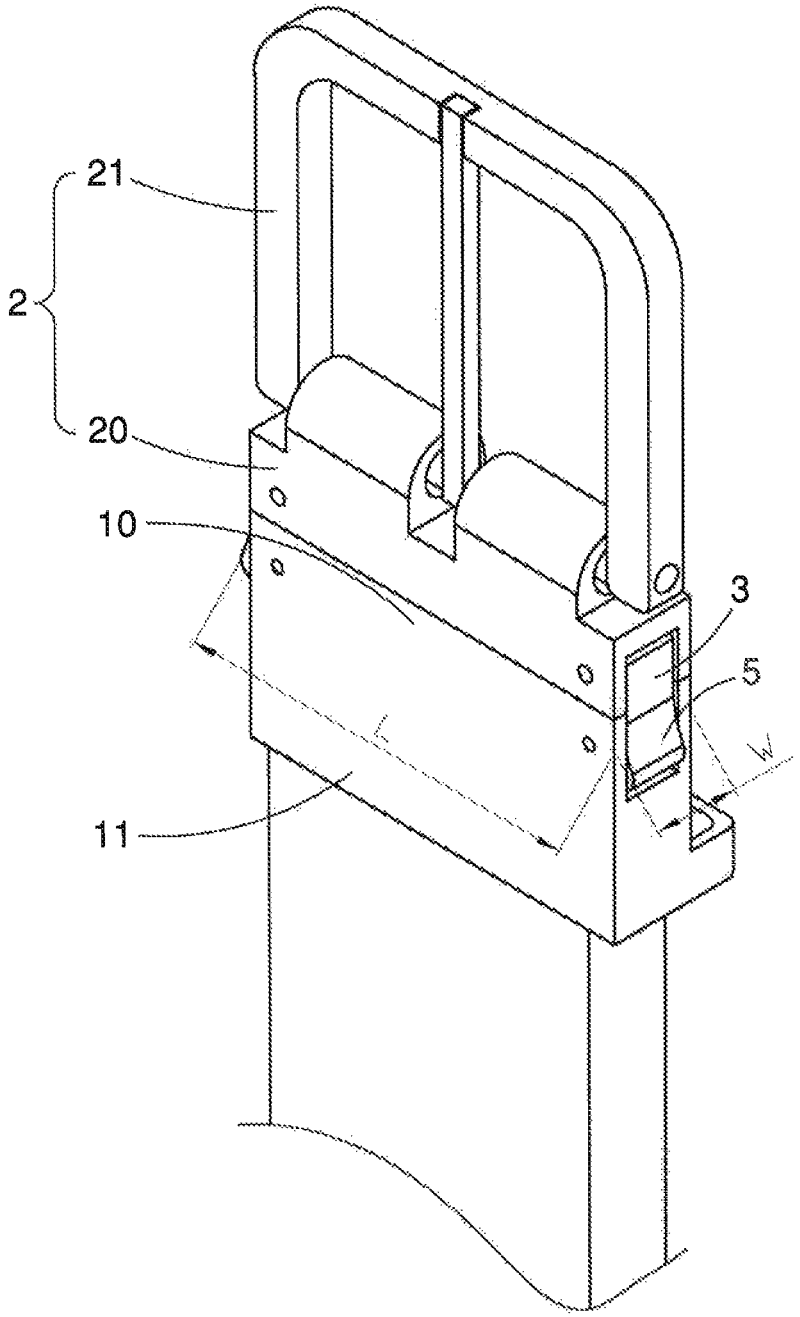
FIG. 3 is a perspective view of the belt head according to the first embodiment of the present invention.

FIGS. 1 to 4 show a first embodiment of a belt head of the present invention. As shown in FIG. 1, the belt head comprises a seat 1, a buckle portion 2, a first engaging portion 3, a second engaging portion 4, a first button 5 and a second button 6. The seat 1 has a front end portion 10 and a rear portion 11 opposite to the front end portion 10. Referring to FIG. 3, the front end portion 10 has two narrow side surfaces facing to each other and spaced apart with a distance L. Each of the two narrow side surfaces has a width W smaller than the distance L. The rear end portion 11 is used to connect with and fix an end of a strap 9. For example, two screws can be used to screw the end of the strap 9 to the rear end portion 11 from an inner side surface of the rear end portion 11, which enables the screws to abut against the end of the strap 9. As such, the strap 9 cannot be separated from the seat 1 of the belt head.

Referring to FIGS. 1 and 2, the buckle portion 2 has a connecting base 20 and a fastening base 21. The connecting base 20 is connected with the front end portion 10 of the seat 1. The connecting base 20 has a first blocking member 23 and a second blocking member 24 which are parallelly disposed thereon. The fastening base 21 has a passage 212 and a fastener 211, wherein the passage 212 allows the opposite end of the strap 9 to pass through, and the fastener 211 is used to fasten or release the strap 9. In this embodiment, the fastening base 21 is pivotably connected with the connecting base 20 by a pivot shaft 22 and therefore the fastening base 21 and the connecting base 20 are not only connected with each other, but also rotatable with each other. Moreover, the fastener 211 is a rod-shaped fastener, which is pivotably engaged with the pivot shaft 22 and is rotatable with respect to the pivot shaft 22. And, while the opposite end of the strap 9 pass through the passage 212 of the fastening base 21 from an inner side of the fastening base 21 to an outer side of the fastening base 21, the fastener 211 is operated to insert into one of holes of the strap 9 to fasten the strap 9, which makes the strap 9 cannot be pulled. While the fastener 211 is pulled out of the hole of the strap 9, the strap 9 is then released. Except the abovementioned way, there are different traditional ways to fasten or to release the strap 9, which are not described in detail hereinafter. The fastening base 21 mentioned above is a preferred embodiment of the present invention, which is not to limit the scope of the present invention. Take FIGS. 5 and 6 as examples, the fastening base 21*a* is another type of the fastening base of the buckle portion in accordance with a preferred embodiment of the present invention, which will be described in detail hereafter.

Figure 4:
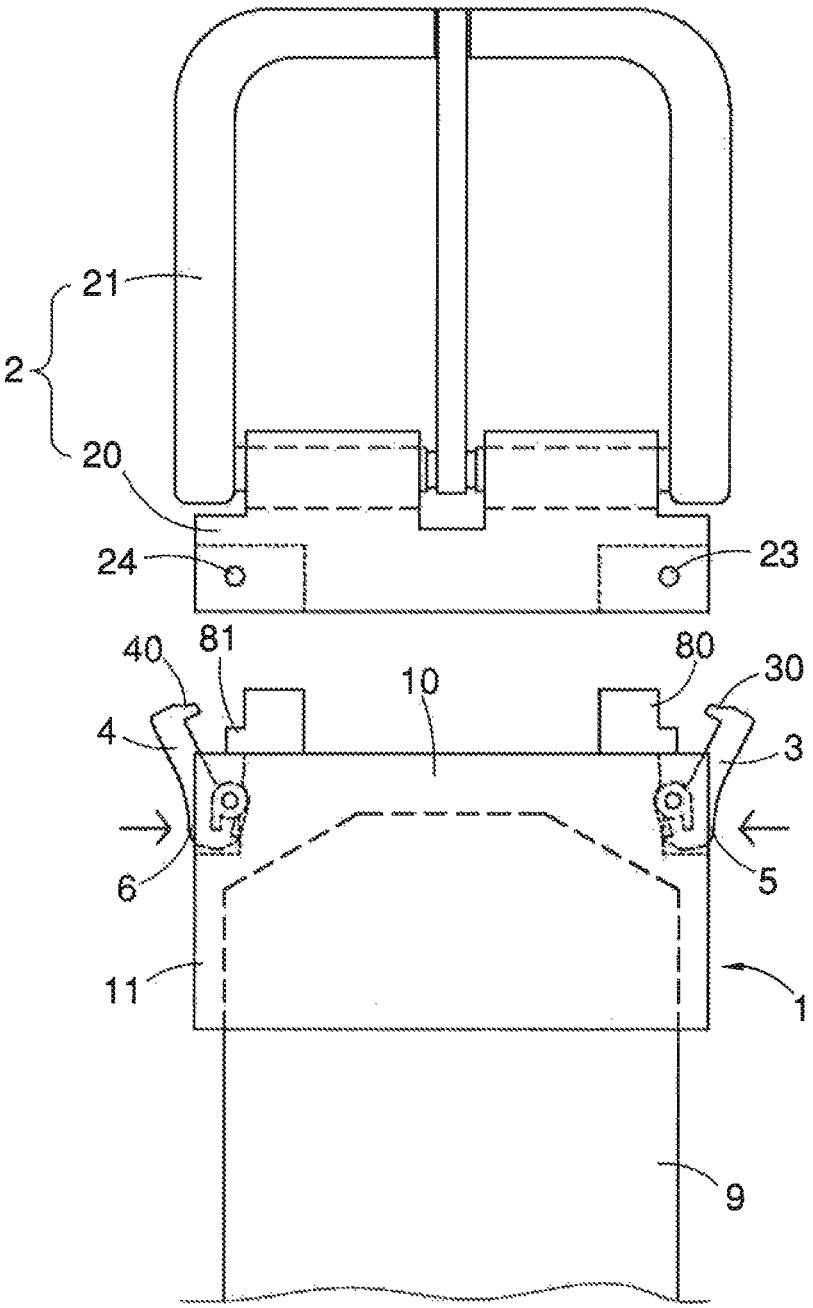
FIG. 4 is a plan view of the belt head under a releasing condition according to the first embodiment of the present invention.

The first engaging portion 3 is disposed on the front end portion 10 of the seat 1, more specifically, on a side of the front end portion 10. The first engaging portion 3 is movable between a first position where the first engaging portion 3 engages with the first blocking member 23, as shown in FIG. 2, and a second position where the first engaging portion 3 releases from the first blocking member 23, as shown in FIG. 4. The first button 5 is located on one of the narrow side surfaces of the front end portion 10 of the seat 1, and the first button 5 serves as a switch to drive the first engaging portion 3 to move between the first and second positions. In this embodiment, the first engaging portion 3 is pivotably connected with the front end portion 10 by a first pin 31, such that the first engaging portion 23 can swing around with respect to the front end portion 10 of the seat 1. Preferably, the first engaging portion 3 has a hook 30 at one end thereof. The hook 30 is used to engage with the first blocking member 23 or to release from the first blocking member 23 when the first engaging portion 3 is moved to the first position or the second position. Moreover, the belt head further includes a first resilient member 70 disposed between the first engaging portion 3 and the front end portion 10 of the seat 1. The first resilient member 7 is used to provide an elastic force to make the hook 30 of the first engaging portion 3 to bounce toward the first blocking member 23, which thus allows the hook 30 of the first engaging portion 3 to be engaged with the first blocking member 23 without easily releasing from the first blocking member 23. However, while the first button 5 is switched from an original position to another position, the first engaging portion 3 is therefore moved with the first button 5. At this time, the hook 30 of the first engaging portion 3 is then swung from the first position with referring to FIG. 2 to the second position with referring to FIG. 4.

Furthermore, in the first embodiment, the first button 5 and the first engaging portion 3 are preferably formed integrally, and the first resilient member 70 is a torsion spring. Specifically, the button 5 extends from the other end of the first engaging portion 3 and slightly protrudes from one of the narrow side surfaces of the front end portion 10. The first resilient member 70 is mounted around the first pin 31 and the two opposite ends of the first resilient member 70 respectively abut against two opposite side walls of the front side portion 10. A pivot joint (that is the first pin 31) where the first engaging portion 3 is pivotably engaged with the front end portion 10, is located between the hook 30 and the button 5 and is closer to the button 5. Thus, while the first button 5 is pressed, the first engaging portion 3 is moved with the first button 5, which enables the hook 30 thereof to be moved from the first position to the second position. During the period of pressing the button 5, the elastic force of the first resilient member 70 is accumulated. Once the first button 5 is released, the hook 30 will bounce toward the first position automatically by the elastic force of the first resilient member 70.

The second engaging portion 4 is disposed on the front end portion 10 of the seat 1, more specifically, on another narrow side surface of the front end portion 10 and facing the first engaging portion 3. The second engaging portion 4 is configured to be movable between a first position where the second engaging portion 4 engages with the second blocking member 24, as shown in FIG. 2, and a second position where the second engaging portion 4 releases from the second blocking member 24, as shown in FIG. 4. The second button 6 is located on the another narrow side surface of the front end portion 10 of the seat 1 and faces the first button 5. The second button 6 serves as a switch to drive the second engaging portion 4 to move between the first and second positions. In the present embodiment, the second engaging portion 4 is identical to the first engaging portion 3, which is pivotably connected to the front end portion 10 of the seat 1 by a second pin 41. Similar to the first resilient member 70, a second resilient member 71 is located between the second engaging portion 4 and the front end portion 10. And, the second button 6 is similar to the first button 5. Thus, the relationship and the operating process of the second engaging portion 4, a hook 40 and the second button 6 are also similar to those mentioned above, which is not described in detail herein.

FIG. 2 shows that the seat 1 and the buckle portion 2 of the belt head of the present invention are connected with each other by the first and second engaging portions 3, 4. Under this situation, a belt composed by the belt head and the strap 9 is provided for a user to wear. And while the user finds that the buckle portion 2 is broken, or the user wants to have a new style of the buckle portion, the user can easily press the first button 5 and the second button 6 at the same time to enable the hook 30 of the first engaging portion 3 and the hook 40 of the second engaging portion 4 to rotatably move to the second position for releasing the buckle portion 2 from the seat 1 rather than replacing the entire belt head. After that, the user can assemble a new buckle portion, which also has above-mentioned structure, on the seat 1 and then release the first button 5 and the second button 6 to make the new buckle portion being securely connected to the seat 1.

Preferably, referring back to FIGS. 1 and 2, the belt head of the present invention further includes a first supporting block 80 and a second supporting block 81 which are disposed protrudingly on the front end portion 10. The first supporting block 80 has a side surface facing the hook 30 of the first engaging portion 3. While the hook 30 is moved to engage a side of the first blocking member 23, the opposite side of the first blocking member 23 abuts against the side surface of the first supporting block 80. The second supporting block 81 also has a. side surface facing the hook 40 of the second engaging portion 4. While the hook 40 is moved to engage a side of the second blocking member 24, the opposite side of the second blocking member 24 abuts against the side surface of the second supporting block 81. Thus, while the buckle portion 2 is twisted or pulled improperly, the first and second blocking members 23, 24 will not be broken easily by the support of the first and second supporting blocks 80, 81.

Figure 5:
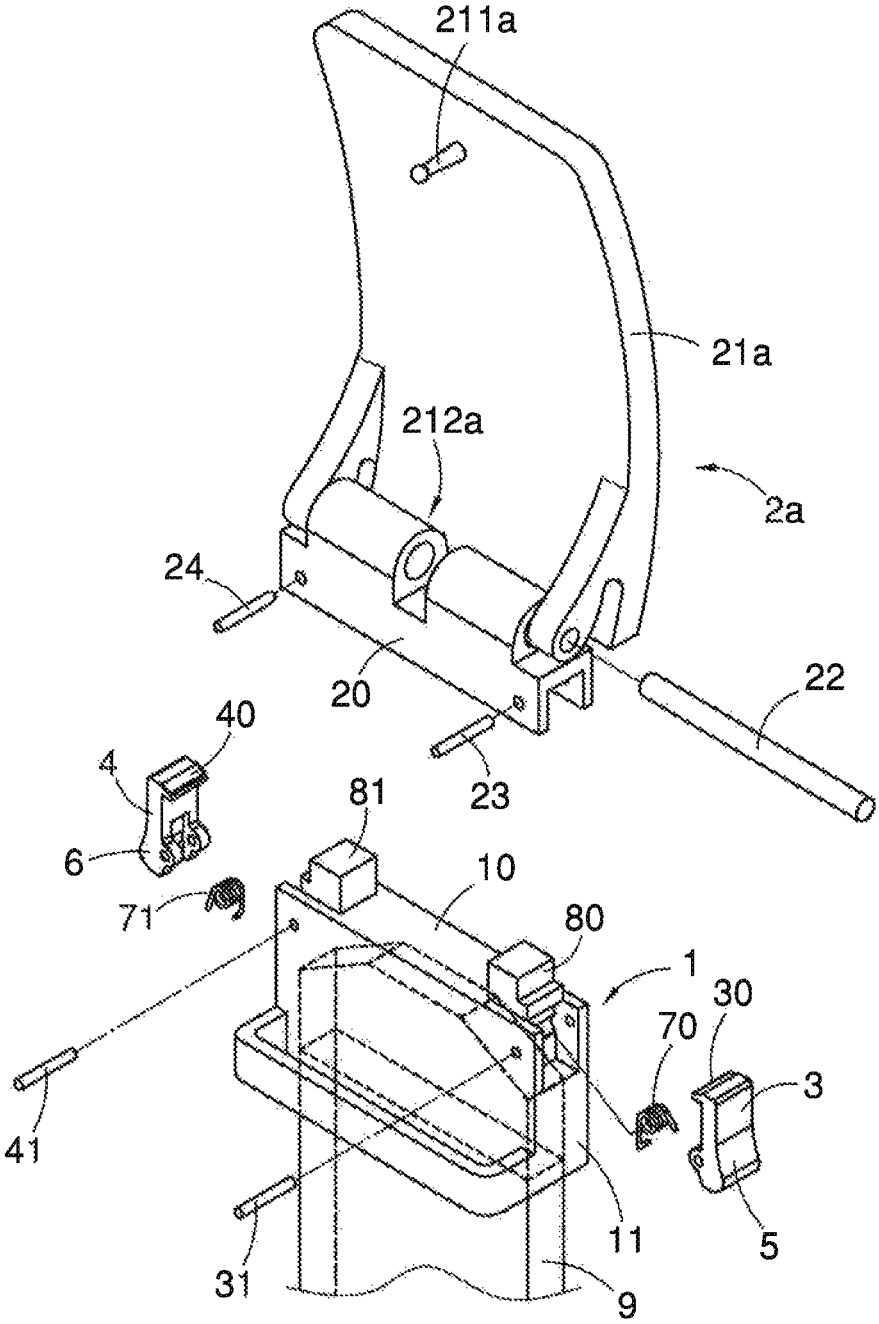
FIG. 5 is an exploded view of a belt head according to a second embodiment of the present invention.
Figure 6:
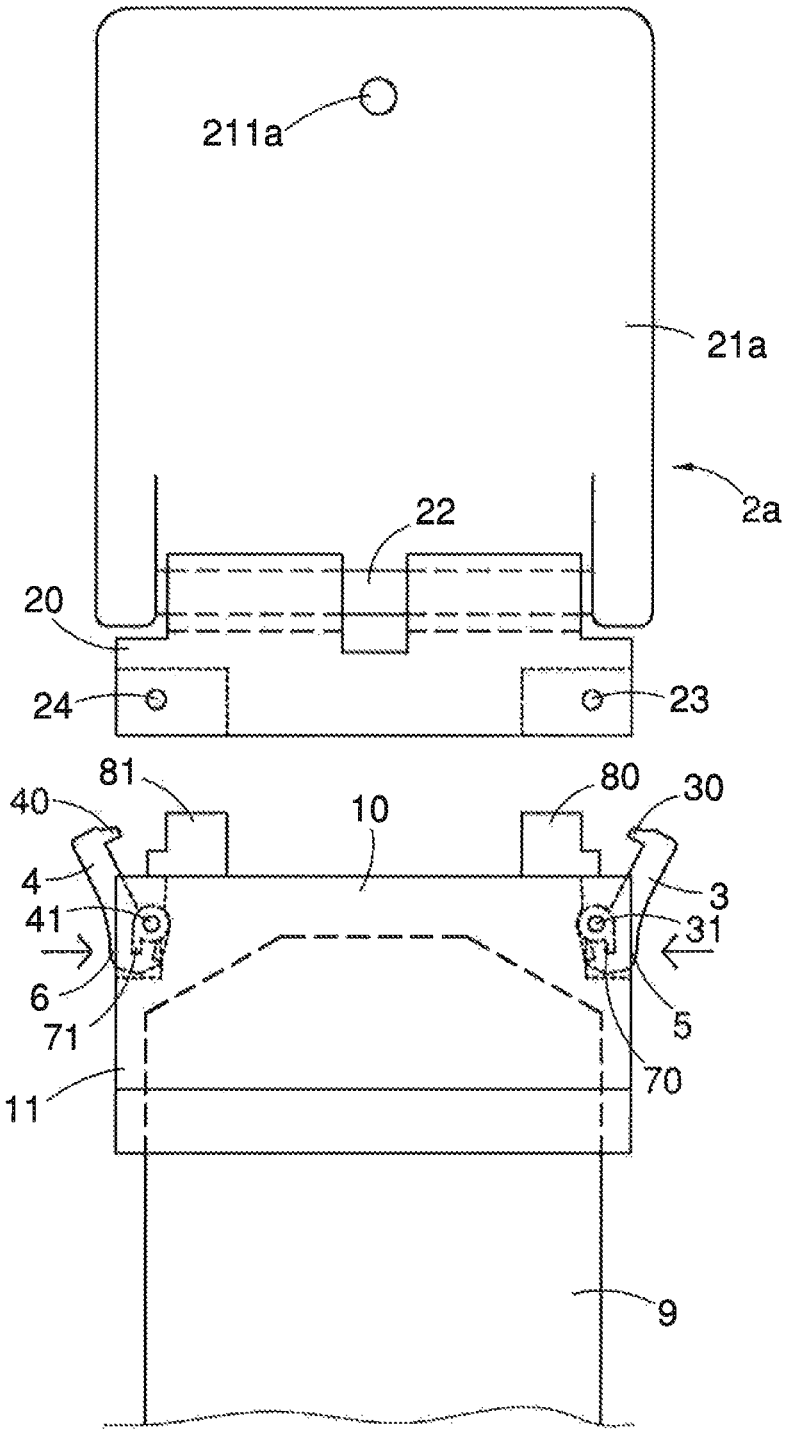
FIG. 6 is a plan view of the belt head under a releasing condition according to the second embodiment of the present invention.

FIGS. 5 and 6 show a second embodiment of a belt head of the present invention. The belt head of the second embodiment is substantially identical to the belt head of the first embodiment, which is not described in detail herein. The only difference in the belt head between the first and the second embodiment is the shape and structure of a buckle portion 2*a*. Specifically, a passage 212*a* of a fastening base 21*a* of the buckle portion 2*a* that allows the strap 9 to pass through is closer to the connecting base 20, and a fastener 211*a* thereof is a rod which cannot be rotated. However, the function of the buckle portion 2*a* is similar to the buckle portion 2 of the first embodiment.

Figure 7:
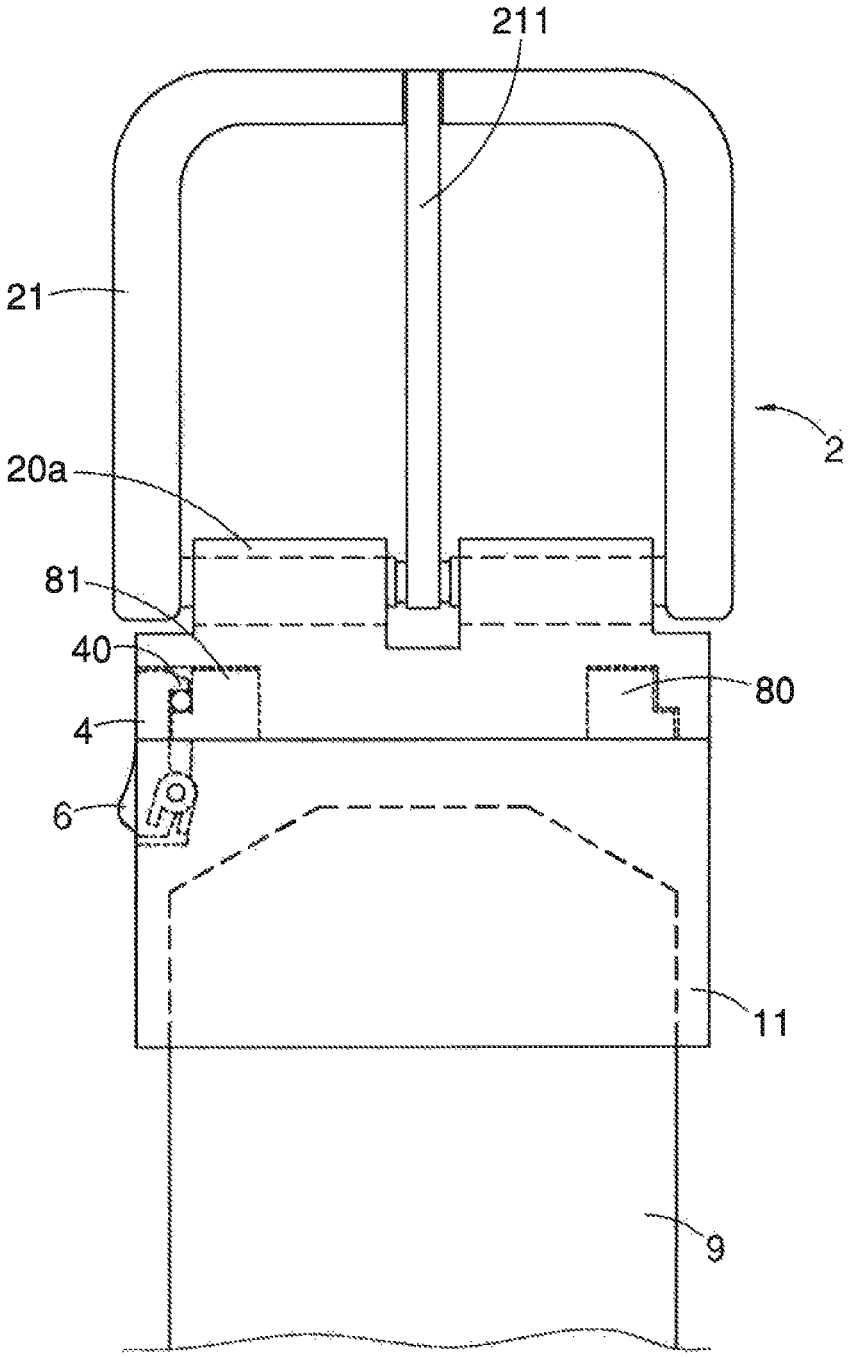
FIG. 7 is a plan view of the belt head under an engaging condition according to a third embodiment of the present invention.
Figure 8:
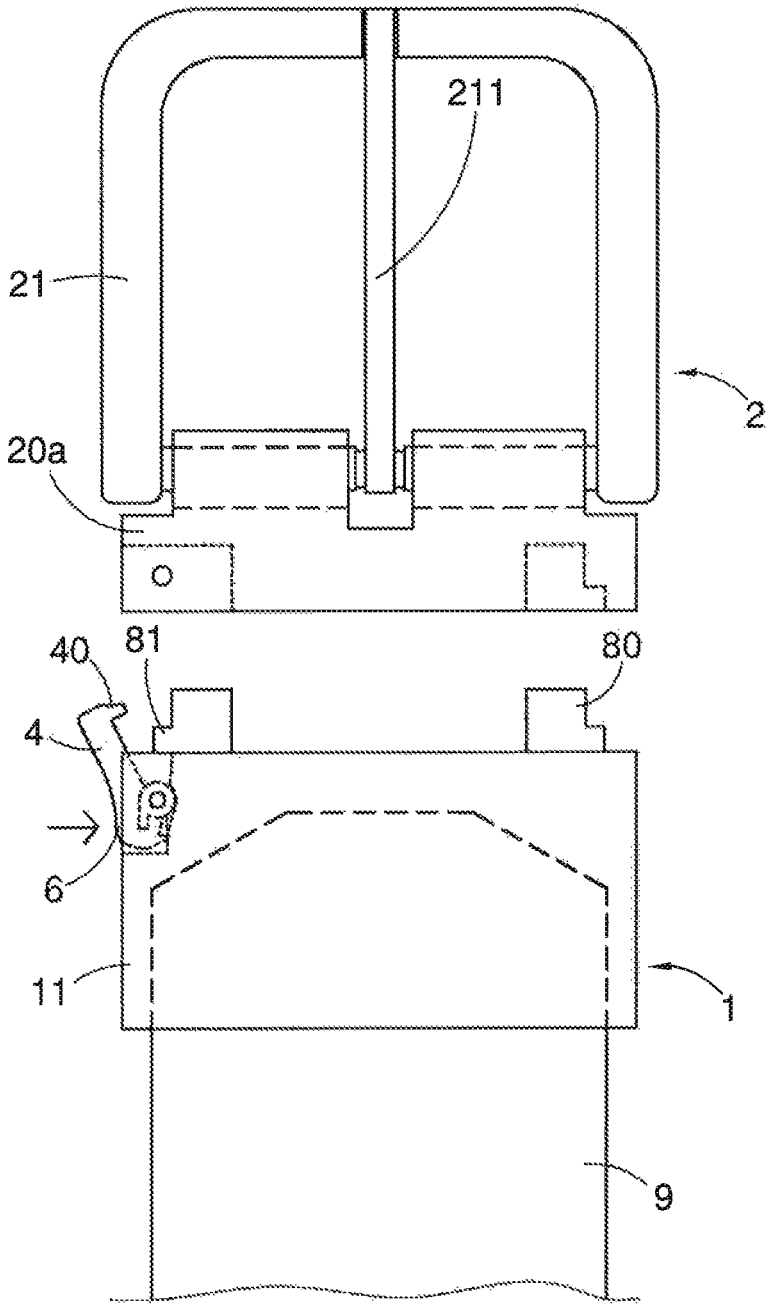
FIG. 8 is a plan view of the belt head under a releasing condition according to the third embodiment of the present invention.

Accordingly, the first and second embodiments both have two engagement mechanisms, one consisting of the first engaging portion 3, the first button 5, the first blocking member 23 and the first resilient member 70, and the other one consisting of the second engaging portion 4, the second button 6, the second blocking member 24 and the second resilient member 71, respectively. However, referring to the FIGS. 7 and 8 that show a third embodiment of a belt head of the present invention, the belt head just has one engagement mechanism to engage the buckle portion and the seat. In detail, the belt head of the third embodiment employs the engagement mechanism which consists of the second engaging portion 4, the second button 6, the second blocking member 24 and the second resilient member 71. Moreover, the belt head of the third embodiment further has the first and second supporting blocks 80, 81, and the function of the first and second supporting blocks 80, 81 is similar to those disclosed in the first and second embodiments, which is not described in detail herein. However, since the belt head of the third embodiment does not have the first blocking member 23, the first supporting block 80 can be taken off optionally.

Figure 9:
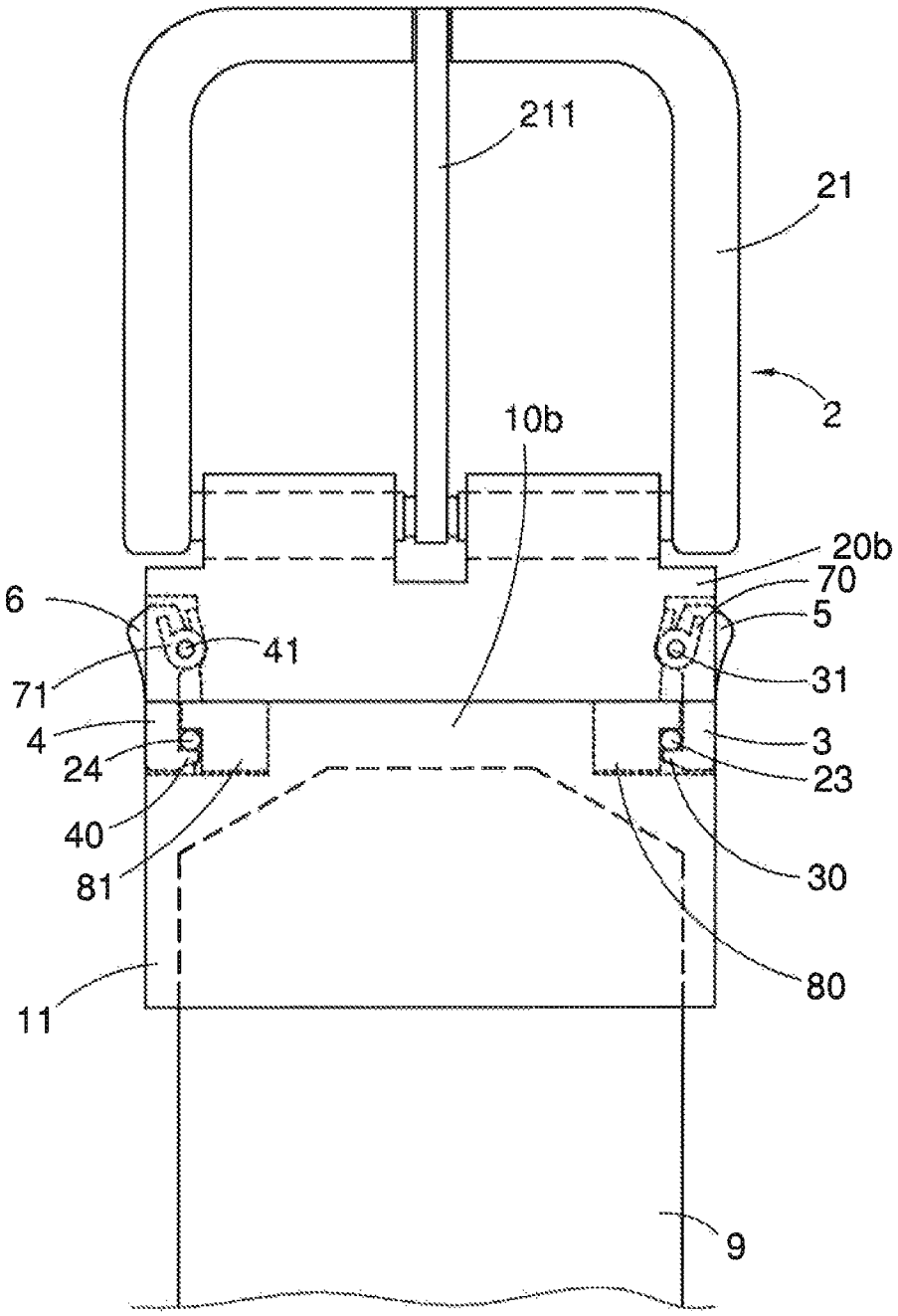
FIG. 9 is a plan view of the belt head under an engaging condition according to a forth embodiment of the present invention.
Figure 10:
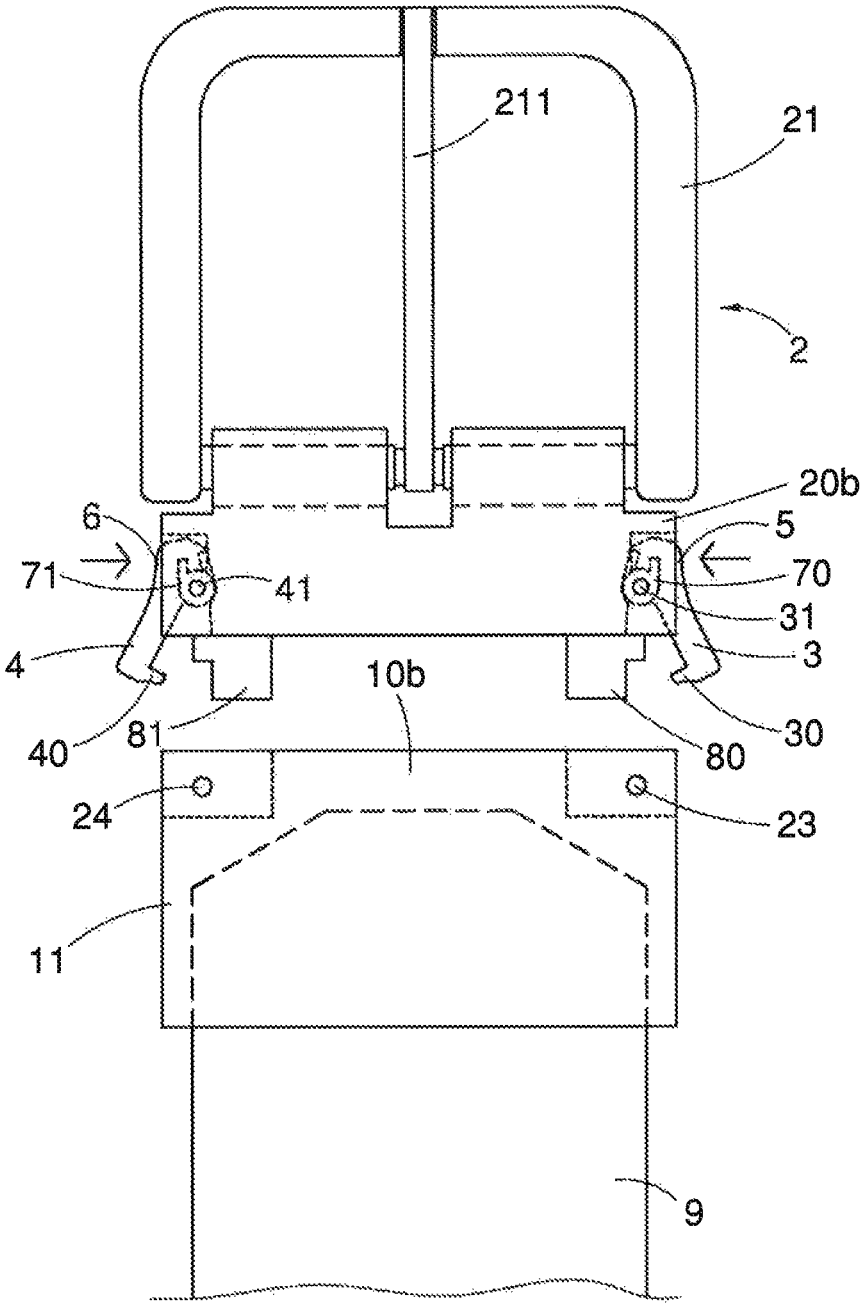
FIG. 10 is a plan view of the belt head under a releasing condition according to the forth embodiment of the present invention.

FIGS. 9 and 10 show a forth embodiment of a belt head of the present invention. The fourth embodiment provides a different way to connect the seat and the buckle portion of the belt head, which is contrary to the first and second embodiments. In the present embodiment, the belt head still has two engagement mechanisms, and each has the same function as those mentioned in the first and second embodiments. The reference numerals associated with the elements shown in FIGS. 9 and 10 are identical to those mentioned in the first and second embodiments, which are not described in detail herein. The difference is that the first and second blocking members 23, 24 of the fourth embodiment are parallelly disposed on a front end portion 10*b* of the seat 1. The first engaging portion 3, the first button 5 and the first resilient member 70 are disposed on a narrow side surface of a connecting base 20*b* of the buckle portion 2. The second engaging portion 4, the second button 6 and the second resilient member 71 are disposed on another narrow side surface of the connecting base 20*b* of the buckle portion 2. And, the first and second supporting blocks 80, 81 are disposed on the connecting base 20*b* of the buckle portion 2. However, the operation and the function of the belt head disclosed in the forth embodiment is substantially as same as the belt head disclosed in the first and second embodiments.

Figure 11:
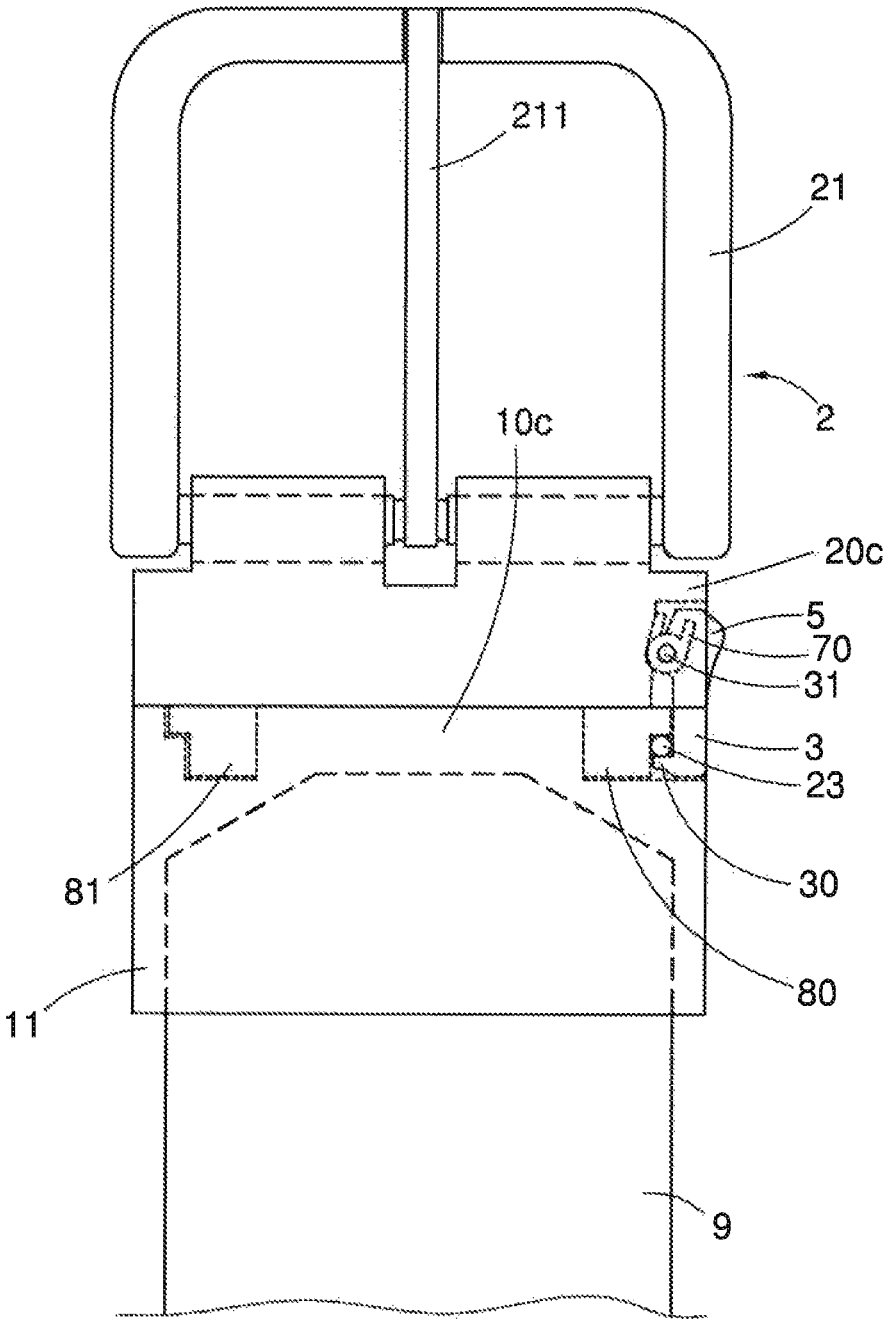
FIG. 11 is a plan view of the belt head under an engaging condition according to a fifth embodiment of the present invention.
Figure 12:
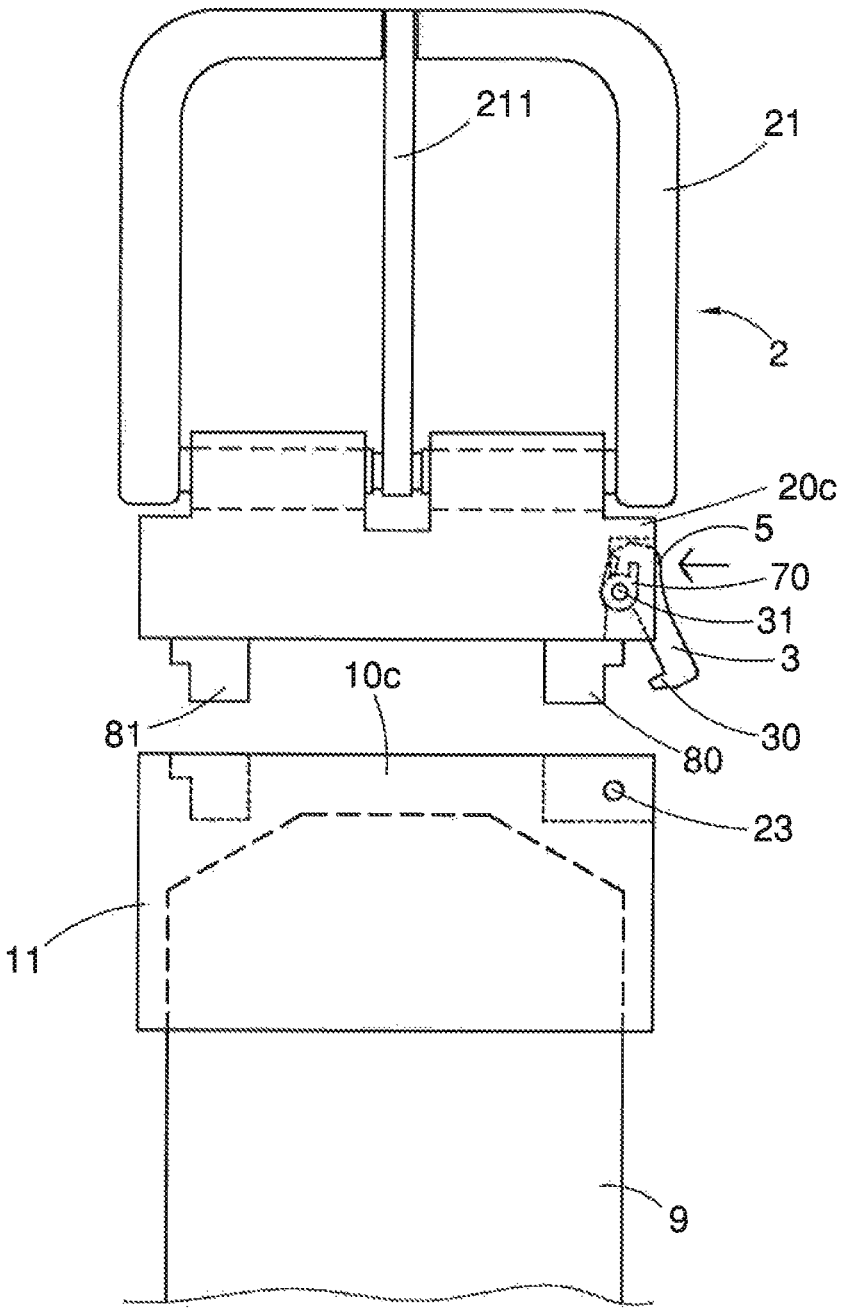
FIG. 12 is a plan view of the belt head under a releasing condition according to the fifth embodiment of the present invention.

Although the forth embodiment discloses that the belt head has two engagement mechanisms, one consisting of the first engaging portion 3, the first button 5, the first blocking member 23 and the first resilient member 70, and the other one consisting of the second engaging portion 4, the second button 6, the second blocking member 24 and the second resilient member 72, respectively. But the belt head may just has one engagement mechanism like the belt head of the third embodiment. Referring to FIGS. 11 and 12 in accordance with a fifth embodiment of the present invention, a belt head only has one engagement mechanism. Specifically, the engagement mechanism of the belt head in the fifth embodiment consists of the first engaging portion 3, the first button 5, the first blocking member 23 and the first resilient member 70. And, the belt head of the fifth embodiment also has the first and second supporting members 80, 81 with the same function like the first and second supporting members 80, 81 in the previously mentioned embodiments. The first engaging portion 3, the first button 5 and the first resilient member 70 and the first and second supporting members 80, 81 are located on a connecting base 20*c* of the buckle portion 2, and the first blocking member 23 is disposed on a front end portion 10*c* of the seat 1. Furthermore, since the belt head does not include the second blocking member 24 in the fifth embodiment, it is not necessary to include the second supporting block in the fifth embodiment either.

The invention claimed is:

1. A belt head for connecting with a strap, the belt head comprising:

a seat having a front end portion and a rear end portion, the front end portion having two narrow side surfaces facing each other and being spaced apart with a distance, the width of each of the narrow side surfaces being smaller than the distance; the rear end portion being used to connect and fix an end of the strap;

a buckle portion having a connecting base and a fastening base, wherein the connecting base is detachably assembled to the front end portion of the seat and has a first blocking member and a second blocking member; the fastening base has a passage that allows the other end of the strap to pass through, and a fastener for fastening or releasing the other end of the strap;

a first engaging portion pivotably connected with the front end portion of the seat, the first engaging portion having a hook at one end thereof used to engage with or release from the first blocking member and being movable between a first position where the first engaging portion engages with the first blocking member and a second position where the first engaging portion releases from the first blocking member;

a first resilient member located between the first engaging portion and the front end portion of the seat for providing an elastic force enabling the hook of the first engaging portion to bounce toward the first blocking member;

a first button located at one of the narrow side surfaces of the front end portion of the seat, the first button configured to control the first engaging portion to move between the first position to engage with the first blocking member and the second position to release from the first blocking member;

a first supporting block protruding from the front end portion of the seat, wherein while the hook of the first engaging portion is engaged with a side of the first blocking member, the first supporting block inserts into the connecting base to make the first blocking member located between the first supporting block and the first engaging portion;

a second engaging portion pivotably connected with the front end portion of the seat, the second engaging portion having a hook at one end thereof used to engage with or release from the second blocking member and being movable between a first position where the second engaging portion engages with the second blocking member and a second position where the second engaging portion releases from the second blocking member;

a second resilient member located between the second engaging portion and the front end portion of the seat for providing an elastic force enabling the hook of the second engaging portion to bounce toward the second blocking member;

a second button located at the other narrow side surface of the front end portion of the seat, the second button configured to control the second engaging portion to move between the first position to engage with and the second position to release from the second blocking member; and a second supporting block protruding from the front end portion of the seat, wherein while the hook of the second engaging portion is engaged with a side of the second blocking member, the second supporting block inserts into the connecting base to make the second blocking member located between the second supporting block and the second engaging portion.

2. The belt head of claim 1, wherein the first button extends from the other end of the first engaging portion and protrudes from one of the narrow side surfaces; the front end portion of the seat has a pivot joint where the first engaging portion is pivotably connected with the front end portion of the seat, the pivot joint is located between the hook of the first engaging portion and the first button, and the pivot joint is closer to the first button than the hook of the first engaging portion.

3. The belt head of claim 1, wherein the first supporting block has a side surface facing the hook of the first engaging portion; while the hook of the first engaging portion is engaged with the side of the first blocking member, the opposite side of the first blocking member abuts against the side surface of the first supporting block.

4. The belt head of claim 1, wherein the second button extends from the other end of the second engaging portion and protrudes from the other narrow side surface;

the front end portion of the seat has a pivot joint where the second engaging portion is pivotably connected with the front end portion of the seat, the pivot joint is located between the hook of the second engaging portion and the second button, and the pivot joint is closer to the second button than the hook of the second engaging portion.

5. The belt head of claim 1, wherein the second supporting block has a side surface facing the hook of the second engaging portion; while the hook of the second engaging portion is engaged with the side of the second blocking member, the opposite side of the second blocking member abuts against the side surface of the second supporting block.

6. The belt head of claim 1, wherein the connecting base is pivotably connected with the fastening base.

7. A belt head for connecting with a strap, the belt head comprising:

a seat having a front end portion and a rear end portion, the front end portion having a first blocking member and a second blocking member, the rear end portion being used to connect and fix an end of the strap;

a buckle portion having a connecting base and a fastening base, the connecting base having two narrow side surfaces facing each other and being spaced apart with a distance, the width of each of the narrow side surfaces being smaller than the distance; wherein the connecting base is detachably assembled to the front end portion of the seat; the fastening base has a passage that allows the other end of the strap to pass through, and a fastener for fastening or releasing the other end of the strap;

a first engaging portion pivotably connected with the connecting base, the first engaging portion having a hook at one end thereof used to engage with or release from the first blocking member and being movable between a first position where the first engaging portion engages with the first blocking member and a second position where the first engaging portion releases from the first blocking member;

a first resilient member located between the first engaging portion and the connecting base for providing an elastic force enabling the hook of the first engaging portion to bounce toward the first blocking member;

a first button located at one of the narrow side surfaces of the connecting base, the first button configured to control the first engaging portion to move between the first position to engage with the first blocking member and the second position to release from the first blocking member;

a first supporting block protruding from the connecting base, wherein while the hook of the first engaging portion is engaged with a side of the first blocking member, the first supporting block inserts into the front end portion of the seat to make the first blocking member located between the first supporting block and the first engaging portion;

a second engaging portion pivotably connected with the connecting base, the second engaging portion having a hook at one end thereof used to engage with or release from the second blocking member and being movable between a first position where the second engaging portion engages with the second blocking member and a second position where the second engaging portion releases from the second blocking member;

a second resilient member located between the second engaging portion and the connecting base for providing an elastic force enabling the hook of the second engaging portion to bounce toward the second blocking member;

a second button located at the other narrow side surface of the connecting base, the second button configured to control the second engaging portion to move between the first position to engage with the second blocking member and the second position to release from the second blocking member; and a second supporting block protruding from the connecting base, wherein while the hook of the second engaging portion is engaged with a side of the second blocking member, the second supporting block inserts into the front end portion of the seat to make the second blocking member located between the second supporting block and the second engaging portion.

8. The belt head of claim 7, wherein the first button extends from the other end of the first engaging portion and protrudes from one of the narrow side surfaces; the connecting base has a pivot joint where the first engaging portion is pivotably connected with the connecting base, the pivot joint is located between the hook of the first engaging portion and the first button, the pivot joint is closer to the first button than the hook of the first engaging portion.

9. The belt head of claim 7, wherein the first supporting block has a side surface facing the hook of the first engaging portion; while the hook of the first engaging portion is engaged with the side of the first blocking member, the opposite side of the first blocking member abuts against the side surface of the first supporting block.

10. The belt head of claim 7, wherein the second button extends from the other end of the second engaging portion and protrudes from the other narrow side surface; the connecting base has a pivot joint where the second engaging portion is pivotably connected with the connecting base, the pivot joint is located between the hook of the second engaging portion and the second button, the pivot joint is closer to the second button than the hook of the second engaging portion.

11. The belt head of claim 7, wherein the second supporting block has a side surface facing the hook of the second engaging portion; while the hook of the second engaging portion is engaged with the side of the second blocking member, the opposite side of the second blocking member abuts against the side surface of the second supporting block.

12. The belt head of claim 7, wherein the connecting base is pivotably connected with the fastening base.

* * * * *